US007123252B1

(12) United States Patent
Baek

(10) Patent No.: US 7,123,252 B1
(45) Date of Patent: Oct. 17, 2006

(54) LIQUID CRYSTAL DISPLAY DEVICE WITH MULTI-TIMING CONTROLLER

(75) Inventor: Jong Sang Baek, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 44 days.

(21) Appl. No.: 09/651,260

(22) Filed: Aug. 30, 2000

(30) Foreign Application Priority Data

Jun. 28, 2000 (KR) ..... 2000-36226

(51) Int. Cl.
*G09G 5/00* (2006.01)

(52) U.S. Cl. ..... 345/213; 345/87; 345/204

(58) Field of Classification Search ..... 345/211–213, 345/87–100, 698–699, 204
See application file for complete search history.

(56) References Cited

U.S. PATENT DOCUMENTS 5,049,864 A * 9/1991 Barshinger ..... 345/38
5,241,281 A * 8/1993 Wilkes et al. ..... 345/213
5,406,308 A * 4/1995 Shiki ..... 345/127
5,486,868 A * 1/1996 Shyu et al. ..... 348/524
5,731,798 A * 3/1998 Shin ..... 345/99
5,781,185 A * 7/1998 Shin ..... 345/213
5,859,635 A * 1/1999 Hang et al. ..... 345/213
5,926,174 A * 7/1999 Shibamiya et al. ..... 345/213
5,966,119 A * 10/1999 Hwang ..... 345/213
6,124,850 A * 9/2000 Matsubara ..... 345/204
6,169,533 B1 * 1/2001 Tse ..... 345/115
6,177,922 B1 * 1/2001 Schiefer et al. ..... 345/698
6,329,975 B1 * 12/2001 Yamaguchi ..... 345/99
6,483,502 B1 * 11/2002 Fujiwara ..... 345/213
6,611,247 B1 * 8/2003 Chang et al. ..... 345/99
6,873,312 B1 * 3/2005 Matsueda ..... 345/98

* cited by examiner

*Primary Examiner*—Richard Hjerpe
*Assistant Examiner*—Kimnhung Nguyen
(74) *Attorney, Agent, or Firm*—McKenna Long & Aldridge LLP

(57) ABSTRACT

A liquid crystal display device with a multi-timing controller that generates a timing signal according to an individual display standard from a control signal according to various display standards to drive the liquid crystal display device. In the device, a liquid crystal display panel has a display standard corresponding to an arranged pixel. An interface receives a data inputted from the exterior thereof and a control signal corresponding to the display standard. A timing controller latches and outputs a data inputted from the interface, and generates and outputs timing signals for driving the liquid crystal display panel from the control signal. A driving circuit receives the timing signals from the timing controller to display a picture corresponding to the data on the liquid crystal display panel. In the timing controller, a display standard set part sets one display standard in response to a plurality of display standards and generates a setting signal corresponding to the display standard. A selector has each timing generation information according the plurality of timing standards and outputs a timing information corresponding to the set signal. A timing generator receives the timing information to generate and output the timing signals from the control signal.

9 Claims, 6 Drawing Sheets

LIQUID CRYSTAL DISPLAY DEVICE WITH MULTI-TIMING CONTROLLER

BACKGROUND OF THE INVENTION

1. Field of the Invention

This invention relates to a liquid crystal display device, and more particularly to a liquid crystal display device including a multi-timing controller that produces a timing signal according to each display standard from a control signal according to various standards to drive the liquid crystal display device.

2. Description of the Related Art

Generally, a liquid crystal display device has an inherent resolution corresponding to the number of integrated pixels, and has a higher resolution as its dimension becomes larger. In order to display a high quality of picture, makers of the liquid crystal display device increases a pixel integration ratio within a liquid crystal panel between liquid crystal display devices with same dimension to differentiate the resolution.

The standards of the image signal and the control signals under circumstance of a personal computer, etc. including the liquid crystal display device along with the resolution are set by the Video Electronics Standard Association (VESA) on February, 1989.

The typical standards of displays being commercially available in the current display industry include DOS Mode (640×350, 640×400, 720×400), VGA(640×400), SVGA (800×600), XGA(1024×768), SXGA(1280×1024) and UXGA(1600×1200) Modes, etc.

The LCD has a resolution fixed by the number of arranged pixels and hence requires image signals corresponding to a resolution of the liquid crystal display panel and control signals thereof from the system. Accordingly, the system converts image signals and control signals corresponding to various display standards into image signals and controls signals complying with a resolution and a display standard of the LCD using a scaler chip and the like to apply the same to the LCD.

FIG. 1 is a block diagram showing a configuration of the conventional LCD. In FIG. 1, an interface part 10 receives a data (RGB data) and control signals (e.g., an input clock, a horizontal synchronizing signal, a vertical synchronizing signal and a data enable signal) to apply them to a timing controller 12. A low voltage differential signal (LVDS) interface and a transistor transistor logic (TTL) interface are largely used for a data and control signal transmission to the driving system. Such interfaces are integrated into a single chip along with the timing controller 12 by collecting each function of them.

The timing controller 12 takes advantages of a control signal inputted via the interface part 10 to produce control signals for driving a data driver 18 consisting of a plurality of drive IC's (not shown) and a gate driver consisting of a plurality of gate drive IC's (not shown). Also, the timing controller 12 transfers data inputted from the interface part 10 to the data driver 18. A reference voltage generator 16 generates reference voltages of a digital to analog converter (DAC) used in the data driver 18, which are established by a producer on a basis of a transmissivity to voltage characteristic of the panel. The data driver 18 selects reference voltages in accordance with an input data in response to control signals from the timing controller 12 to convert the same into an analog image signal and apply the converted signal to a liquid crystal panel 22. The gate driver 20 makes an on/off control, one line by one line, of gate terminals of thin film transistors (TFT's) arranged on the liquid crystal panel 22 in response to the control signals inputted from the timing controller 12. Also, the gate driver 20 allows the analog image signals from the data driver 18 to be applied to each pixel connected to each TFT. A power voltage generator 14 supplies an operation voltage to each element, and generates a common electrode voltage and applies it to the liquid crystal panel 22.

In the configuration as mentioned above, the timing controller 12 produces desired control signals for a driving of the LCD in response to the input control signals. In this case, the timing controller 12 generally counts a clock on a basis of the edge of a horizontal synchronizing signal Hsync or a data enable (DE) signal to generate a control signal. The output signals of the timing controller 12 have a difference from each other depending on types of data drive IC and gate drive IC.

Hereinafter, types and timing of control signals used commonly except for signals required specially will be described. First, control signals required for the data driver includes source sampling clock (SSC), source output enable (SOE), source start pulse (SSP), liquid crystal polarity reverse (POL), a data polarity selection or data reverse (REV) and odd/even pixel data signals, etc. The SSC signal is used as a sampling clock for latching a data in the data driver, and which determines a drive frequency of the data drive IC. The SOE signal transfer data latched by the SSC signal to the liquid crystal panel. The SSP signal is a signal notifying a latch or sampling initiation of the data during one horizontal synchronous period. The POL signal is a signal notifying the positive or negative polarity of the liquid crystal for the purpose of making an inversion driving of the liquid crystal. The REV signal is a signal selecting the polarity of the transferred data. The odd/even pixel data signal is a signal representing an odd data of odd-numbered pixels and an even data of even-numbered pixel.

An operation of the data driver receiving the above-mentioned control signals is shown in FIG. 2. Referring to FIG. 2, first, if the data driver recognizes a "high" input of the SSP at the rising or falling edge of the SSC, then it latches a data inputted in response to the SSC. Next, the latched data is decoded into an analog output voltage in response to the SOE and supplies it to the liquid crystal panel. At this time, a positive decoder output voltage higher than the common electrode voltage is selected when the POL signal is a "high" state; while a negative decoder output voltage lower than the common electrode voltage when the POL signal is a "low" state, thereby making an inversion drive of the liquid crystal panel into a positive/negative polarity.

Control signals required for the gate driver includes gate shift clock (GSC), gate output enable (GOE) and gate start pulse (GSP) signals, etc. The GSC signal is a signal determining a time when a gate of the TFT is turned on or off. The GOE signal is a signal controlling an output of the gate driver. The GSP signal is a signal notifying a first drive line of the field in one vertical synchronizing signal.

An operation of the gate driver receiving the above-mentioned control signals is shown in FIG. 3. Referring to FIG. 3, the gate driver recognizes a "high" state of the GSP signal at the rising or falling edge of the GSC signal to output a gate signal maintaining a "high" state during a time interval equal to one period of the GSC signal. At this time, the GOE signal is combined with the gate signal output to disable an output equal to a "high" width of the GOE signal.

As described above, such a LCD requires individual controllers generating the control signals for controlling the data driver and the gate driver from the image signals and the control signals inputted in response to its inherent resolution. However, since the LCD uses various display formats from the VGA mode until the UXGA mode, it requires various timing controllers according to each resolution thereof. For this reason, the conventional LCD has a problem of a cost rise according to a development of the timing controller. In addition, the conventional LCD has a problem in that one developed timing controller can not be used for a liquid crystal display device according to a different display standard.

SUMMARY OF THE INVENTION

Accordingly, it is an object of the present invention to provide a liquid crystal display device with a multi-timing controller wherein a timing signal according to an individual display standard is generated from control signals according to various display standards to drive the liquid crystal display device.

In order to achieve these and other objects of the invention, a liquid crystal display device with a multi-timing controller according to an embodiment of the present invention comprises a liquid crystal display panel having a display standard corresponding to an arranged pixel; an interface receiving a data inputted from the exterior thereof and a control signal corresponding to the display standard; a timing controller for latching and outputting a data inputted from the interface, and for generating and outputting timing signals for driving the liquid crystal display panel from the control signal; and a driving circuit for receiving the timing signals from the timing controller to display a picture corresponding to the data on the liquid crystal display panel, wherein said timing controller includes a display standard set part for setting one display standard in response to a plurality of display standards and generating a setting signal corresponding to the display standard, a selector having each timing generation information according the plurality of timing standards and outputting a timing information corresponding to the set signal, and a timing generator for receiving the timing information to generate and output the timing signals from the control signal.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
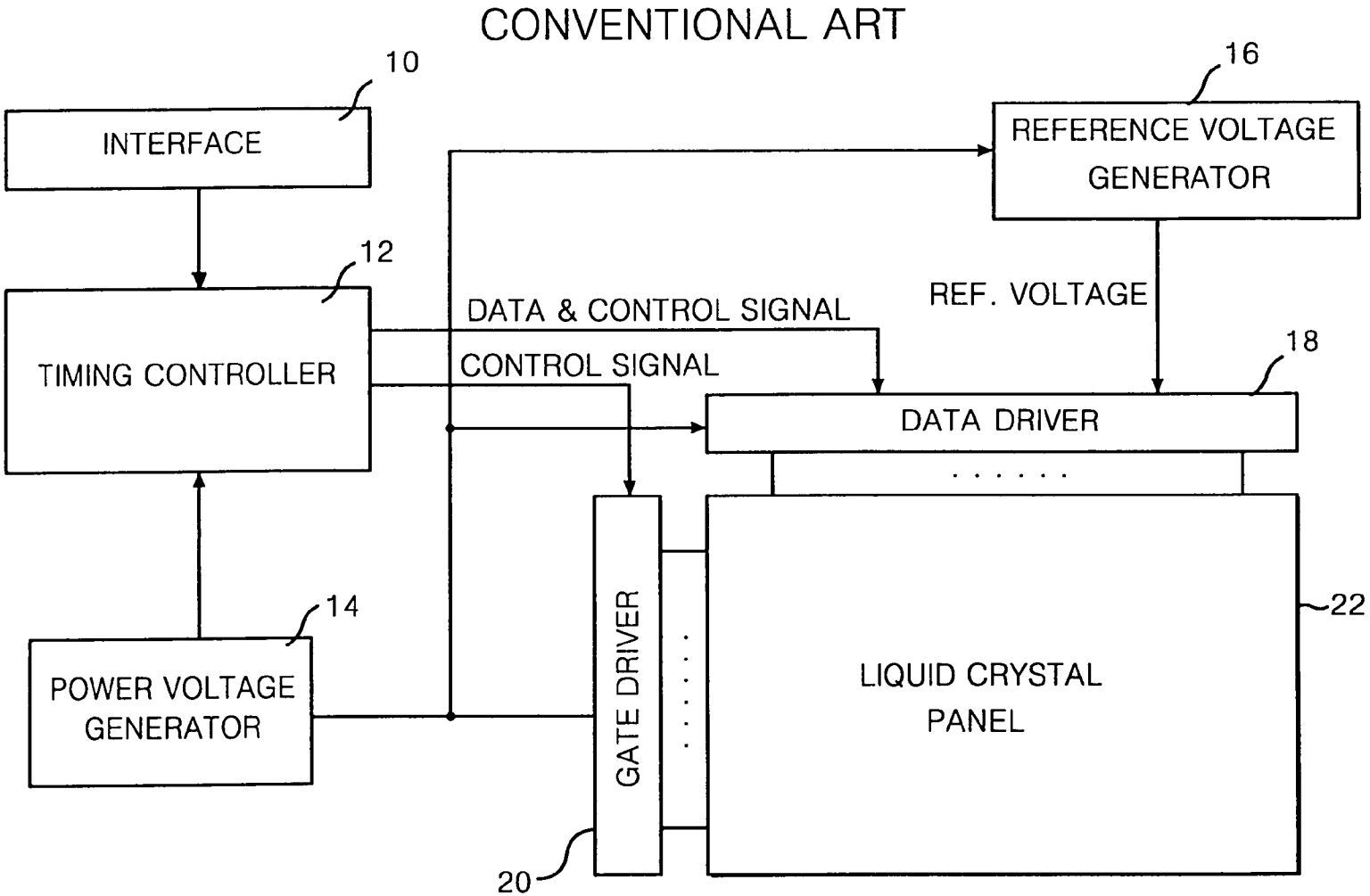
FIG. 1 CONVENTIONAL ART
FIG. 1 is a block diagram showing a configuration of a general liquid crystal display device.
Figure 2:
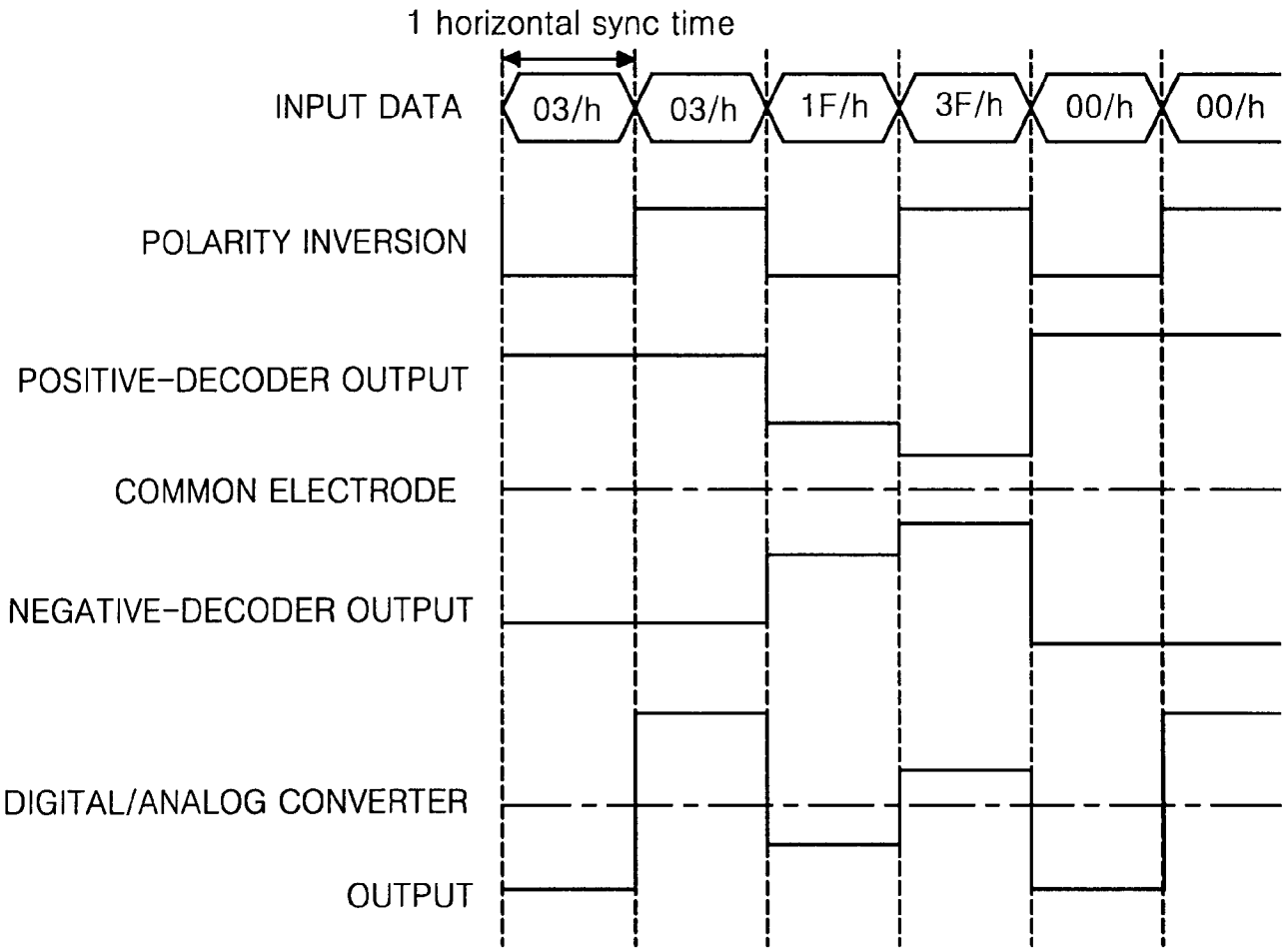
FIG.2 CONVENTIONAL ART
FIG. 2 is waveform diagrams of output signals of the data driver IC shown in FIG. 1.
Figure 3:
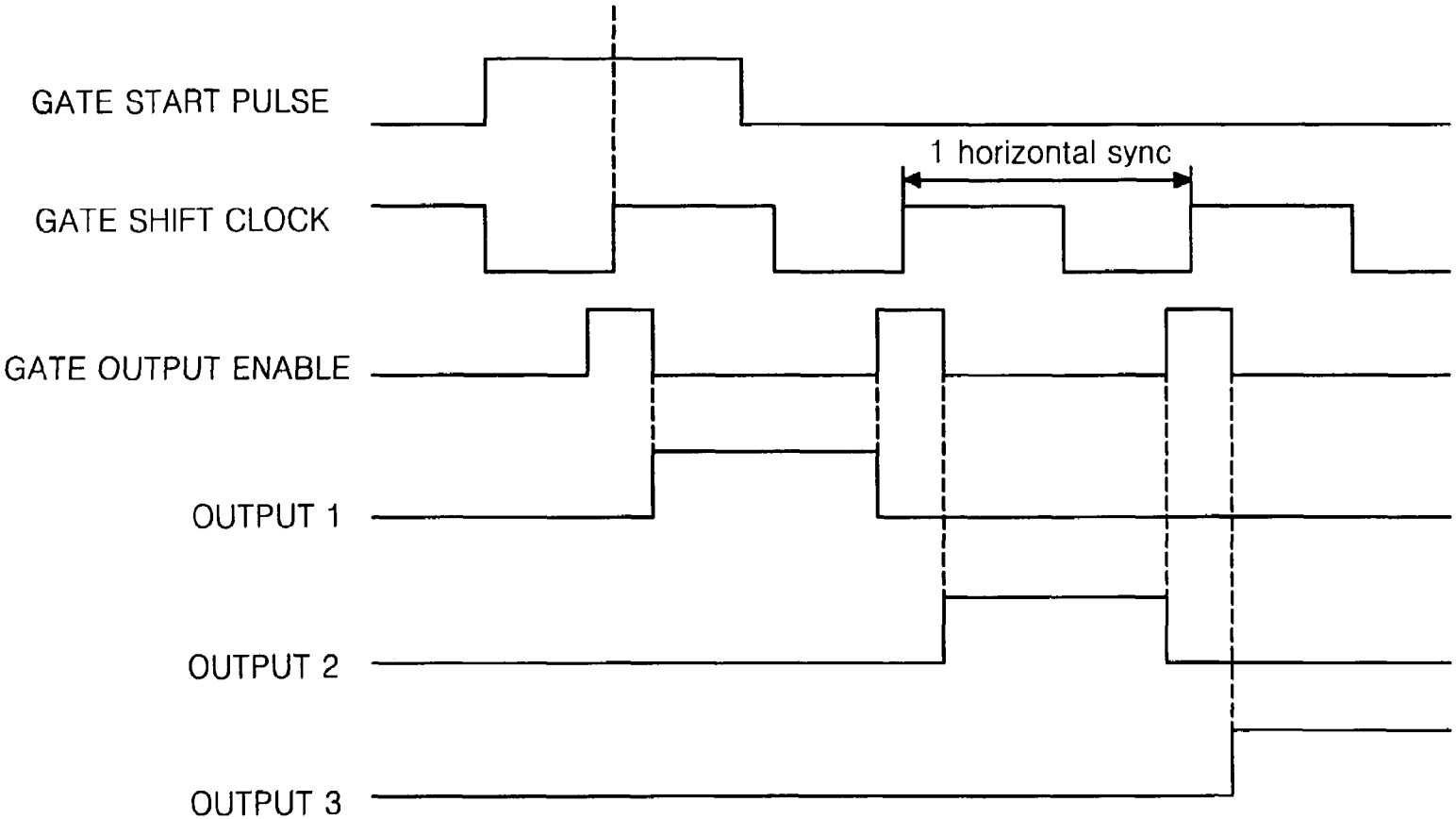
FIG.3 CONVENTIONAL ART
FIG. 3 is waveform diagrams of output signals of the gate driver IC shown in FIG. 1.
Figure 4:
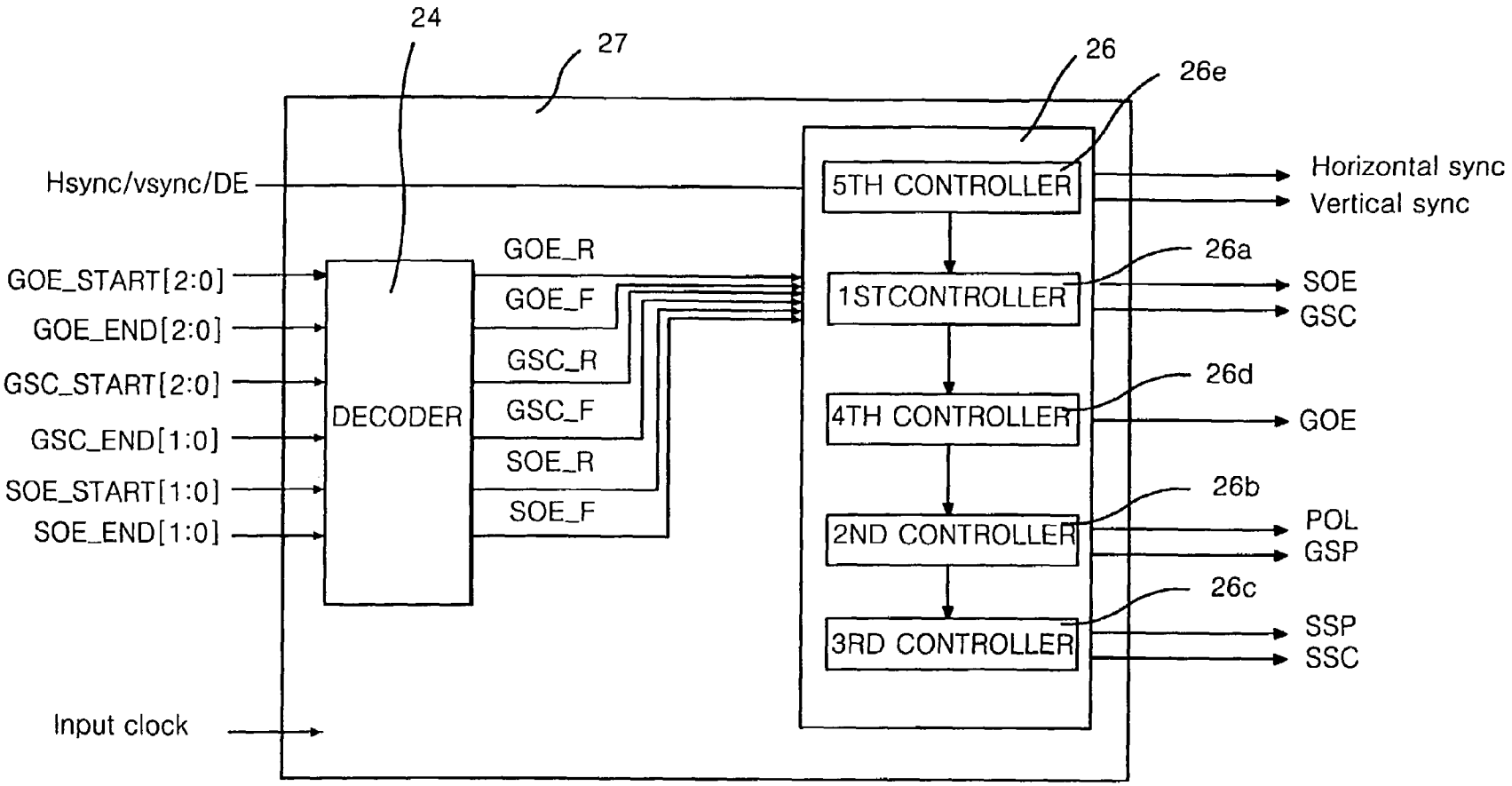
FIG. 4 is a block diagram showing a configuration of a timing controller according to an embodiment of the present invention.

Referring to FIG. 4, there is shown a timing controller according to a first embodiment of the present invention. The timing controller 27 can be divided into a decoder 24 and a timing generator 26 for selecting a desired timing value in accordance with a standard of the liquid crystal display (LCD).

First, the decoder 24 will be described in conjunction with the following Table 1. FIG. 4 explains a selection of the SOE, GSC and GOE signals as an example.

TABLE 1

| Input pin | Setting | Clock | UXGA (60 Hz) 2 pxls/clk 80 MHz | SXGA (60 Hz) 2 pxls/clk 54 MHz | XGA (60 Hz) 2 pxls/clk 32.5 MHz | SVGA (60 Hz) 1 pxls/clk 40 MHz | VGA (60 Hz) 1 pxls/clk 25 MHz |
|---|---|---|---|---|---|---|---|
| GOE START [2:0] | LLL | 32 | 416 | 502 | 829 | 675 | 1072 |
| | LLH | 64 | 909 | 1097 | 1811 | 1475 | 2342 |
| | LHL | 80 | 1155 | 1395 | 2303 | 1875 | 2978 |
| | LHH | 96 | 1401 | 1693 | 2794 | 2275 | 3613 |
| | HLL | 128 | 1894 | 2288 | 3776 | 3075 | 4883 |
| | HLH | 160 | 2387 | 2883 | 4795 | 3875 | 6154 |
| | HHL | 192 | 2880 | 3478 | 5741 | 4675 | 7424 |
| | HHH | 224 | 3373 | 4073 | 6723 | 5475 | 8694 |
| GOE END [2:0] | LLL | 0 | 31 | 37 | 61 | 50 | 79 |
| | LLH | 16 | 277 | 335 | 553 | 450 | 715 |
| | LHL | 32 | 524 | 632 | 1044 | 850 | 1350 |
| | LHH | 48 | 770 | 930 | 1535 | 1250 | 1985 |
| | HLL | 64 | 1016 | 1228 | 2026 | 1650 | 2620 |
| | HLH | 80 | 1263 | 1525 | 2517 | 2050 | 3255 |
| | HHL | 96 | 1509 | 1823 | 3009 | 2450 | 3891 |
| | HHH | 128 | 2002 | 2418 | 3991 | 3250 | 5161 |
| GSC START [2:0] | LLL | 0 | 31 | 37 | 61 | 50 | 79 |
| | LLH | 8 | 154 | 186 | 307 | 250 | 397 |
| | LHL | 16 | 277 | 335 | 553 | 450 | 715 |
| | LHH | 24 | 400 | 484 | 798 | 650 | 1032 |
| | HLL | 32 | 524 | 632 | 1044 | 850 | 1350 |
| | HLH | 40 | 647 | 781 | 1289 | 1050 | 1667 |
| | HHL | 48 | 770 | 930 | 1535 | 1250 | 1985 |
| | HHH | 64 | 1016 | 1228 | 2026 | 1650 | 2620 |
| GSC END | LL | 40 | 693 | 837 | 1382 | 1125 | 1787 |

TABLE 1-continued

| Input pin | Setting | Clock | UXGA (60 Hz) 2 pxls/clk 80 MHz | SXGA (60 Hz) 2 pxls/clk 54 MHz | XGA (60 Hz) 2 pxls/clk 32.5 MHz | SVGA (60 Hz) 1 pxls/clk 40 MHz | VGA (60 Hz) 1 pxls/clk 25 MHz |
|---|---|---|---|---|---|---|---|
| [1:0] | LH | 200 | 3157 | 3813 | 6294 | 5125 | 8139 |
| | HL | 320 | 5005 | 6045 | 9978 | 8125 | 12903 |
| | HH | 400 | 6237 | 7533 | 12434 | 10125 | 16079 |
| SOE START | LL | 0 | 77 | 93 | 154 | 125 | 199 |
| [1:0] | LH | 4 | 139 | 167 | 276 | 225 | 357 |
| | HL | 8 | 200 | 242 | 399 | 325 | 516 |
| | HH | 16 | 323 | 391 | 645 | 525 | 834 |
| SOE END | LL | 32 | 570 | 688 | 1136 | 925 | 1469 |
| [1:0] | LH | 64 | 1063 | 1283 | 2118 | 1725 | 2739 |
| | HL | 96 | 1555 | 1879 | 3101 | 2525 | 4010 |
| | HH | 128 | 2048 | 2474 | 4083 | 3326 | 5280 |

wherein [2:0] and [1:0] represent the number of bus lines. A unit of data indicated in the above Table 1 is ns.

First, a GOE start signal GOE_START determines a start point of the GOE signal and is outputted as a value determining a GOE rising edge GOE_R. A GOE end signal GOE_END determines an end point of the GOE signal and is outputted as a value determining a GOE falling edge GOE_F. A GSC start signal GSC_START determines a start point of the GSC signal and is outputted as a value determining a GSC rising edge GSC_R. A GSC end signal GSC_END determines an end point of the GSC signal and is outputted as a value determining a GSC falling edge GSC_F. A SOE start signal SOE_START determines a start point of the SOE signal and is outputted as a value determining a SOE rising edge SOE_R. A SOE end signal SOE_END determines an end point of the SOE signal and is outputted as a value determining a SOE falling edge SOE_F. An input pulse (input clock) is a reference clock for adjusting a synchronization of the timing controller.

The decoder 24 receives a timing set data from the exterior thereof to output timing count values corresponding to the data. At this time, the timing set data can be set by means of a general dip switch and the like. The decoder 24 stores a number of count values for generating control signals in accordance with a display standard, and output the corresponding timing count value in response to an input timing set data. Since such a structure can be easily implemented by a memory and a multiplexor, a detailed explanation as to this structure will be omitted.

As an example, a driving characteristic of the decoder will be described. First, the decoder 24 selects total eight GOE rising edges when a 3-bit GOE start pulse is inputted. If a 2-bit GOE start pulse is inputted, then the decoder 24 can select total four GOE rising edges. The remaining signals inputted to the decoder 24 also can be selected in the above-mentioned manner, and a value to be selected can be optionally set. In other words, if a GOE start signal with a 3-bit data structure is set to "LHL" to be inputted to the decoder 24, then the decoder 24 selects "80" (decimal) as a value determining a GOE rising edge. This subtracts "80" (decimal) from a reference timing value inputted to the timing generator 26 to determine a GOE rising edge. At this time, when a user selects an UXGA mode in a data stored in a memory, the subtracted "80" (decimal) requires a timing of 1155 ns. In other words, if a user intends to select a timing of 1155 ns in a UXGA mode, a GOE start signal with a 3-bit data structure may be set to "LHL".

The timing generator 26 includes a first controller 26*a* for receiving a timing signal selected from the decoder 24 to generate a required timing, a second controller 26*b* for generating a polarity inverse signal and a gate drive start signal, a third controller 26*c* for generating a source start signal and a SSC, a fourth controller 26*d* for deforming a GOE signal generated from the first controller 26*a*, and a fifth controller 26*e* for keeping the polarity of a horizontal/vertical synchronizing signal always equally. The first controller 26*a* counts and stores an input clock within one horizontal synchronizing signal period and then compares it with a value set at the decoder 24 to generate and output SOE and GSC signals. At the same time, the first controller 26*a* generates a GOE signal to transfer it to the fourth controller 26*d*.

Figure 5:
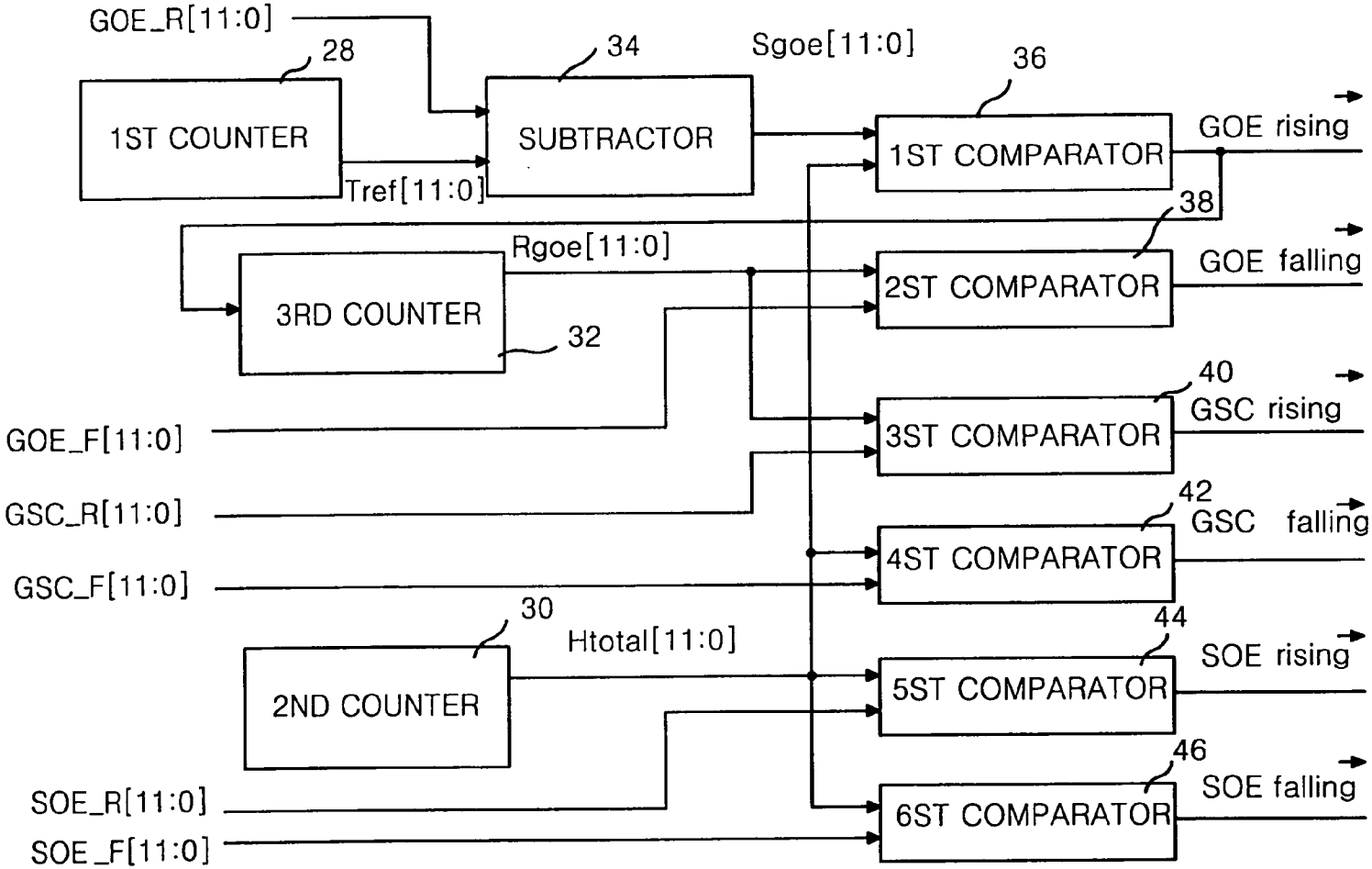
FIG. 5 is a detailed block diagram of the first controller shown in FIG. 4.

FIG. 5 is a block diagram showing a detailed configuration of the first controller. In FIG. 5, the first controller 26*a* includes first to third counters 28, 30 and 32, a subtractor 34, and first to sixth comparators 36, 38, 40, 42, 44 and 46. The first counter 28 receives a horizontal synchronizing signal Hsync and a reference clock to count the reference clock during two horizontal periods and output it as a reference timing value Tref. Thereafter, the subtractor 34 subtracts a GOE rising edge (GOE_R) value from the reference timing value Tref and outputs the subtracted result Sgoe to the first comparator 36. The second counter 30 counts a reference clock every horizontal period to output a current horizontal period count value Htotal.

The first comparator 36 compares the subtracted result Sgoe with the horizontal period count value Htotal to raise the GOE signal when the two input values are equal. The third counter 32 receives an output value of the first comparator 36 as a initializing signal to count a reference clock during one horizontal period and output the counted value Rgoe. Thereafter, the second comparator 38 compares the count value Rgoe of the third counter 32 with a GOE falling edge (GOE_F) value to fall the GOE signal when the two input values are equal. The third comparator 40 compares the count value Rgoe of the third counter 32 with a GSC falling edge (GSC_R) value to raise the GSC signal when the two input values are equal. The fourth comparator 42 compares the count value Htotal of the second counter 30 with a GSC falling edge (GSC_F) value to fall the GSC signal when the two input values are equal. The fifth comparator 44 compares the count value Htotal of the second counter 30 with a SOE rising edge (SOE_R) to raise the SOE signal when the two input values are equal. The sixth comparator 46 compares the count value of the second counter 30 with a SOE falling edge (SOE_F) value to fall the SOE signal when the two input values are equal.

Figure 6:
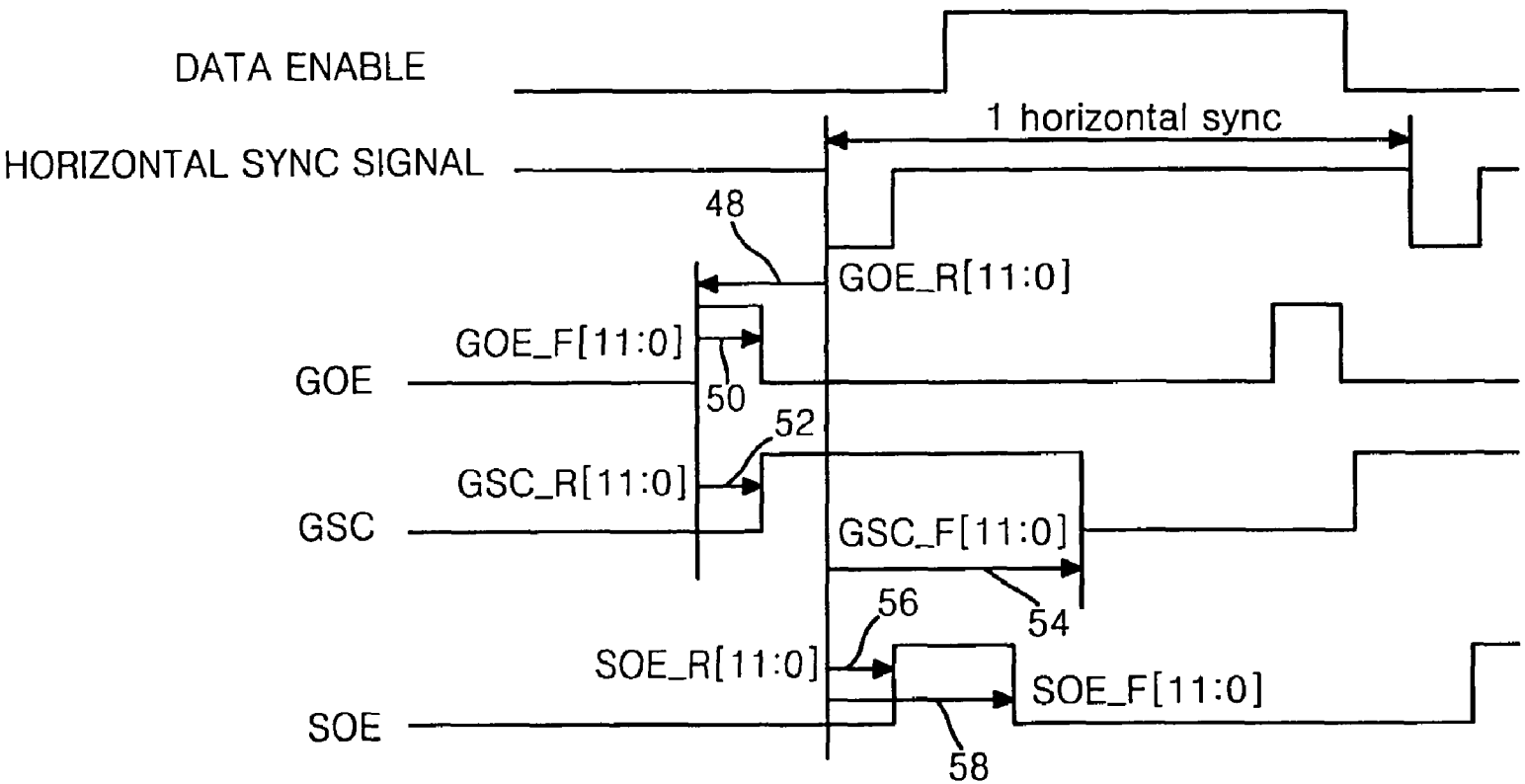
FIG. 6 is waveform diagrams of output signals of the first controller shown in FIG. 4.

FIG. 6 is a timing chart illustrating an output waveform of the first controller shown in FIG. 5. Referring to FIG. 6, the timing generator 26 counts a reference clock by a GOE rising edge (GOE_R) value 48 on a basis of an input horizontal synchronizing signal to determine a rising edge of the GOE signal. Thereafter, the timing generator 26 counts a reference clock by a GOE falling edge (GOE_F) value 50 from the rising edge of the GOE signal to determine a falling edge of the GOE signal.

Subsequently, the timing generator 26 counts a reference clock by a GSC rising edge (GSC_R) value 52 from the rising edge of the GOE signal to determine a rising edge of the GSC signal. Also, the timing generator 26 counts a reference clock by a GSC falling edge (GSC_F) value 54 on a basis of the horizontal synchronizing signal Hsync to determine a falling edge of the GSC signal.

Finally, the timing generator 26 counts a reference clock by a SOE rising edge (SOE_R) value 56 on a basis of the horizontal synchronizing signal Hsync to determine a rising edge of the SOE signal. Also, the timing generator 26 counts a reference clock by a SOE falling edge (SOE_F) value 58 on a basis of the horizontal synchronizing signal Hsync to determine a falling edge of the SOE signal.

As described above, the timing controller according to an embodiment of the present invention receives the timing set data from the exterior thereof from the decoder to output a desired rising timing count value corresponding to the data to the timing generator. The timing generator receives the horizontal synchronizing signal Hsync and the reference clock from the exterior thereof to count the reference clock during two horizontal periods, thereby generating the reference timing value Tref. Thus, the timing generator subtracts the timing count value inputted from the decoder from the generated reference timing value Tref and outputs the subtracted result. Then, the timing generator counts each horizontal period inputted from the exterior thereof by the reference clock to output the current horizontal period count value Htotal and thereafter compares the output current horizontal period count value Htotal with the reference timing value Tref subtracted by the timing count value to output a rising signal to the corresponding line when the two values are equal. Also, the timing generator receives a value outputted by comparing the current horizontal period count value Htotal with the reference timing value Tref subtracted by the timing count value as an initializing signal to count the reference clock during one horizontal period and output the counted value Rgoe. Consequently, the timing generator compares a desired falling timing count value received from the decoder with the count value Rgoe to output a falling signal to the corresponding line when the two values are equal.

As described above, the liquid crystal display device with the multi-timing controller according to the present invention counts the number of all clocks within one horizontal synchronization time, thereby correspondingly generating the control signals using the adder, the subtractor and the comparator, etc. even though a resolution is changed. Accordingly, it can generally employ a single controller without requiring an inherent timing controller according to each corresponding model.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device with a multi-timing controller, comprising:

a liquid crystal display panel having a display standard;

an interface receiving a timing data inputted from the exterior thereof and a control signal corresponding to the display standard;

a timing controller for latching and outputting the timing data inputted from the interface, and for generating and outputting timing signals for driving the liquid crystal display panel based on the control signal; and a driving circuit for receiving the timing signals outputted from the timing controller to display a picture corresponding to the display standard, wherein said timing controller includes a decoder and a timing generator, wherein timing generation information corresponding to a plurality of display standards is stored by the decoder, wherein the decoder outputs, to the timing generator, timing information corresponding to the timing data, wherein the timing generator outputs timing signals corresponding to the timing information and the control signal, wherein the timing generator includes a first controller for generating the timing signal corresponding to the timing information selected from the decoder and a second controller for generating a liquid crystal polarity inversion signal indicating a driving voltage polarity of the liquid crystal provided on the liquid crystal display panel and a gate drive starting signal for notifying a first drive line of a field from one vertical synchronizing signal, a third controller for generating a signal information a sampling start of a data and a source sampling clock for latching a data at the rising or falling edge during one horizontal synchronization period, a fourth controller for deforming a gate output enable signal generated from the first controller by making the gate output enable signal into a high state during a certain time so as to prevent a latch-up badness in which all the outputs of a gate drive integrate circuit goes to a high state thereby disabling the gate drive integrated circuits, and a fifth controller for always equally keeping the polarity of the horizontal/vertical synchronizing signal.

2. The liquid crystal display device as claimed in claim 1, further comprising a dip switch for selecting the timing data corresponding to the display standard.

3. The liquid crystal display device as claimed in claim 1, wherein the decoder consists of a memory for storing a certain timing information and a multiplexor for selecting any one of the timing information stored in the memory.

4. The liquid crystal display device as claimed in claim 1, wherein the first controller includes:

a first counter for receiving the horizontal synchronizing signal inputted from the fifth controller and the first timing information inputted from the decoder to count the timing information during two horizontal periods and thus output a first count value;

a subtractor for subtracting the timing information from the first count value to output a reference timing signal;

a second counter for counting the timing information every period of the horizontal synchronizing signal to output a second count value for the current horizontal period;

a first comparator for comparing the second count value with the reference timing signal to output a first selection timing signal;

a third counter for receiving the first selection timing signal as an initializing signal to count the reference clock during one horizontal period and thus output a third count value;

a second comparator for receiving the third count value to compare it with a second timing information inputted from the decoder, thereby outputting a second selection timing signal when the two input values are equal;

a third comparator for receiving the third count value to compare it with a third timing information inputted from the decoder, thereby outputting a third selection timing signal when the two input values are equal;

a fourth comparator for comparing the second count value with a fourth timing information inputted from the decoder to output a fourth selection timing signal when the two input values are equal;

a fifth comparator for comparing the second count value with a fifth timing information inputted from the decoder to output a fifth selection timing signal when the two input values are equal; and a sixth comparator for comparing the second count value with a sixth timing information inputted from the decoder to output a sixth reference timing signal when the two input values are equal.

5. The liquid crystal display device as claimed in claim 2, wherein the display standard is selected from any one of SVGA, XGA, SXGA, UXGA, and VGA display standards.

6. A multi-timing controller, comprising:

a decoder for storing timing generation information corresponding to a plurality of display standards, wherein the decoder is connected to a source outputting timing data; and a timing generator connected to an output of the decoder and to a source outputting a control signal and to a source outputting a control signal corresponding to one of the plurality of display standards, wherein the timing generator outputs, to a display device, timing signals corresponding to an output of the decoder and the control signal, wherein the timing generator includes a first controller that generates the timing signal output by the timing generator and a second controller that generates a polarity inversion signal indicating a driving voltage polarity and a starting signal for notifying a first drive line of a field from one vertical synchronizing signal, and wherein the first controller includes:

a first counter for receiving a horizontal synchronizing signal and the first timing information inputted from the decoder to count the timing information during two horizontal periods and thus output a first count value;

a subtractor for subtracting the timing information from the first count value to output a reference timing signal;

a second counter for counting the timing information every period of the horizontal synchronizing signal to output a second count value for the current horizontal period;

a first comparator for comparing the second count value with the reference timing signal to output a first selection timing signal;

a third counter for receiving the first selection timing signal as an initializing signal to count the reference clock during one horizontal period and thus output a third count value;

a second comparator for receiving the third count value to compare it with a second timing information inputted from the decoder, thereby outputting a second selection timing signal when the two input values are equal.

7. The multi-timing controller of claim 6, wherein the decoder includes a memory and a multiplexor.

8. The multi-timing controller of claim 6, wherein the timing generator includes a third controller, a fourth controller, and a fifth controller, wherein:

the first controller is connected to an output of the fifth controller;

the second controller is connected to an output of the fourth controller;

the third controller is connected to an output of the second controller and generates a signal informing a sampling start of a data and a source sampling clock for latching a data at the rising or falling edge during one horizontal synchronization period;

the fourth controller is connected to an output of the first controller and deforms a gate output enable signal generated by the first controller, thereby making the gate output enable signal into a high state during a certain time in which all the outputs of a driver circuit are in a high state, thereby disabling the driver circuit; and the fifth controller maintains the polarity of the control signal.

9. The liquid crystal display device as claimed in claim 8, wherein the first controller includes:

a third comparator for receiving the third count value to compare it with a third timing information inputted from the decoder, thereby outputting a third selection timing signal when the two input values are equal;

a fourth comparator for comparing the second count value with a fourth timing information inputted from the decoder to output a fourth selection timing signal when the two input values are equal;

a fifth comparator for comparing the second count value with a fifth timing information inputted from the decoder to output a fifth selection timing signal when the two input values are equal; and a sixth comparator for comparing the second count value with a sixth timing information inputted from the decoder to output a sixth reference timing signal when the two input values are equal.

* * * * *